US008397614B2

(12) United States Patent
Gianneschi

(10) Patent No.: US 8,397,614 B2
(45) Date of Patent: Mar. 19, 2013

(54) SYSTEM FOR COMMUNICATING DATA TO A DETONATING FUSE OF A FIREARM

(75) Inventor: Nicola Gianneschi, La Spezia (IT)

(73) Assignee: Oto Melara S.p.A., La Spezia (IT)

( * ) Notice: Subject to any disclaimer, the term of this patent is extended or adjusted under 35 U.S.C. 154(b) by 0 days.

(21) Appl. No.: 13/106,666

(22) Filed: May 12, 2011

(65) Prior Publication Data

US 2011/0283911 A1 Nov. 24, 2011

(30) Foreign Application Priority Data

May 13, 2010 (IT) ..... TO2010A0402

(51) Int. Cl.
*F42C 17/00* (2006.01)

(52) U.S. Cl. ..... 89/6.5; 89/6

(58) Field of Classification Search ..... 89/6, 6.5
See application file for complete search history.

(56) References Cited

U.S. PATENT DOCUMENTS 4,970,960 A 11/1990 Feldmann
6,129,024 A 10/2000 Gerber et al.
6,170,377 B1 * 1/2001 Larsson et al. ..... 89/6.5
7,077,045 B2 * 7/2006 Dietrich et al. ..... 89/6

FOREIGN PATENT DOCUMENTS

| | | |
|---|---|---|
| DE | 10 2008 017 437 | 10/2009 |
| EP | 0 918 209 | 5/1999 |
| WO | WO 97/39304 | 10/1997 |
| WO | WO 2009/121467 | 10/2009 |

* cited by examiner

*Primary Examiner* — Stephen M Johnson
*Assistant Examiner* — John D Cooper
(74) *Attorney, Agent, or Firm* — Merchant & Gould P.C.

(57) ABSTRACT

A system communicates data to a detonating fuse (3) of a projectile (P) of a firearm, and sends the data to a processing unit, inserted in the fuse. The projectile is of the under-caliber type with respect to the size of the barrel for which, in order to correctly insert the projectile in the same, an adaptor is used, formed by a capsule (2) fitting on the projectile, having an outer diameter which substantially corresponds to that of the barrel.

5 Claims, 2 Drawing Sheets

SYSTEM FOR COMMUNICATING DATA TO A DETONATING FUSE OF A FIREARM

This application claims benefit of Serial No. To 2010 A 000402, filed 13 May 2010 in Italy and which application is incorporated herein by reference. To the extent appropriate, a claim of priority is made to the above disclosed application.

BACKGROUND

The present invention relates to a system for communicating data to a detonating fuse of a firearm. In particular, the present invention relates to a system for data communication to a detonating fuse of munitions, adapted to transfer to the fuse itself and in particular to an electronic unit for managing fuses, the necessary information for the correct reaching of the target.

It is known that programmable fuses are available, inside which electronic systems for driving the projectile are present, determining the trajectory of the projectile, in order to correctly reach the target. Such systems can be based on heat sensors, for detecting the heat radiated by the target, or on radio-frequency sensors, which detect the position of the target, in order to drive the projectile towards it. Other systems are based, for example, on GPS detectors, which drive the projectile towards the position of the target, known from its GPS coordinates.

The program for inserting the driving system contained in the fuses must be stored in the fuse, before the projectile is ejected from the firearm.

A system used in the known technique provides that such transfer occurs in an electro-magnetic way inside the firearm. A suitable writing device sends an electro-magnetic codified signal to an antenna, comprised in the fuse, which is decoded by an electronic unit of management of the system.

Another known system for programming the fuse is of a mechanical type, in which by means of moving flanges or sleeves, associated to the fuse itself, the programming parameters are set. In this case, the programming is made before the insertion of the projectile in the firearm.

The programming made in an electromagnetic way in the firearm is often difficult, because for obvious reasons, the ambiance is noisy, and there are many factors which can influence the electromagnetic waves.

SUMMARY

The present invention obviates to the cited drawbacks, by providing a system for communicating data to the fuse, in which the unloading of the program for inserting the fuse occurs in an electric way, by means of electric conductive elements, realized on the fuse itself, on a front capsule in which the fuse is housed, in order to be driven in the barrel of the firearm, and to create an electric conductive path from a central electronic unit, controlling the firearm, to the electronic processing unit present in the fuse.

An aspect of the present invention refers to a system for data communication/communicating data to a fuse of a firearm.

BRIEF DESCRIPTION OF THE DRAWINGS

Further scopes and advantages of the present invention will be clear from the following description and from the annexed drawings, given here for example only, in a exemplary and non limiting way, in which.

DETAILED DESCRIPTION

Figure 1:
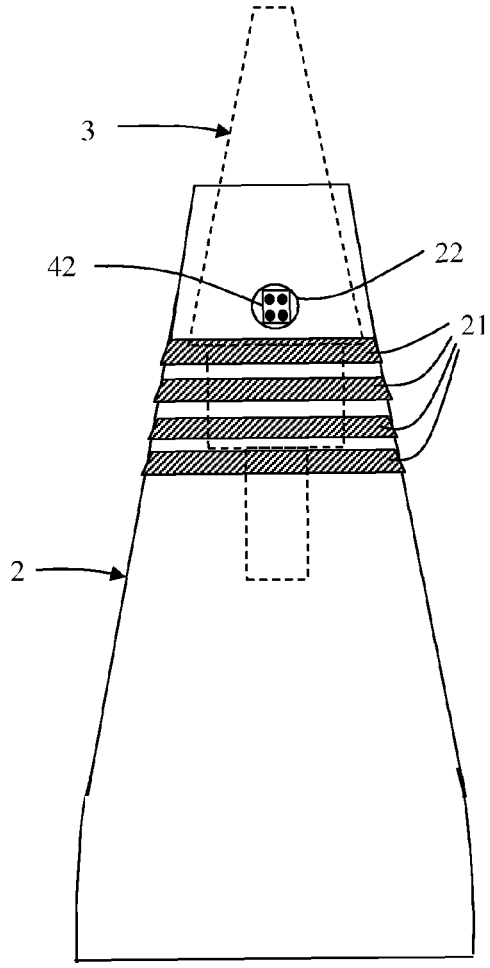
FIG. 1 schematically represents in an exploded view a detonating fuse inserted in a so-called front "sabot", according to the present invention.
Figure 2:
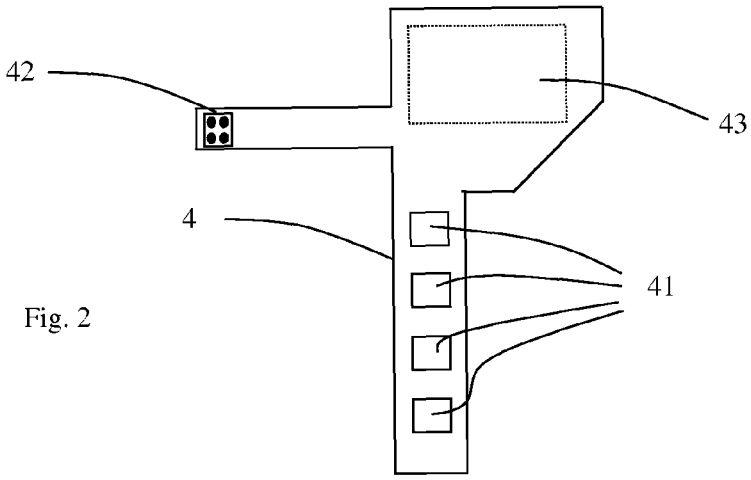
FIG. 2 shows an electronic circuit for communicating the front sabot with the fuse according to the present invention.
Figure 3:
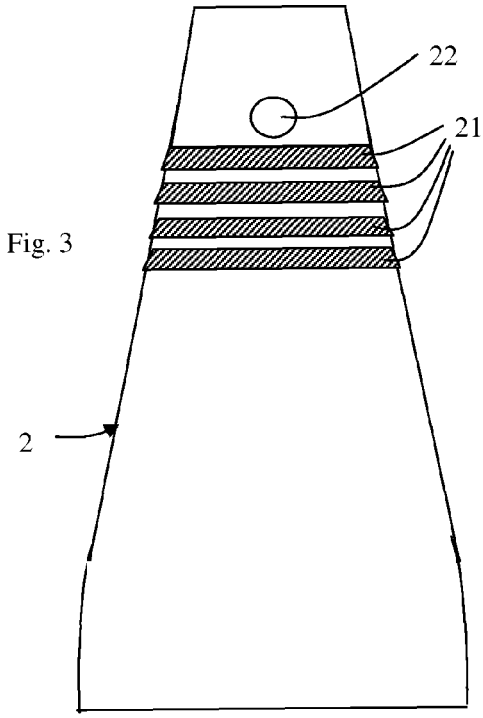
FIG. 3 shows the front sabot according to the present invention.
Figure 4:
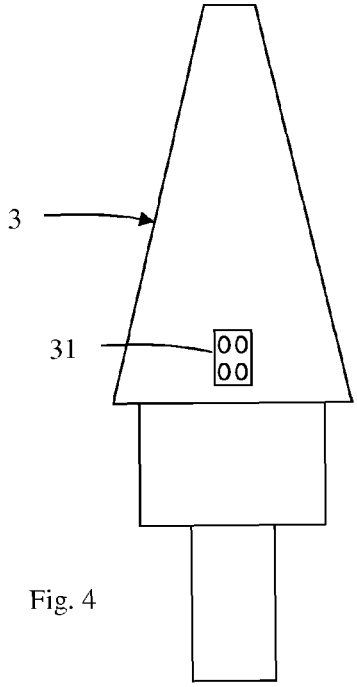
FIG. 4 shows a fuse according to the present invention.
Figure 5:
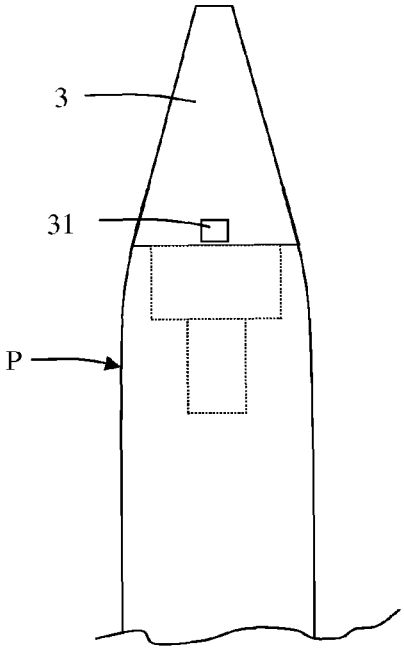
FIG. 5 partially shows a projectile provided with the fuse according to the present invention.

With reference to the cited figures, the system according to the present invention applies to a firearm of the type comprising a barrel, from which projectile P is shot, and to a charging mechanism, which provides for the insertion of the projectile in the barrel.

In this kind of firearm, the sizes of the projectile are normally lower than the diameter of the barrel. In these cases it is known as "under-calibre" ammunitions, for which, in order to correctly insert the projectile in the barrel, an adaptor is used, formed by some kind of front capsule 2, having an outer diameter substantially corresponding to that of the barrel which is fitted on the projectile. The projectile with capsule 2 is fitted on its fuse 3, and in such a way it is correctly and easily inserted in the barrel.

In the phase just before the insertion of the projectile in the barrel, fuse 3 is charged, by insertion of the capsule 2 in the barrel.

Such operation is advantageously made after having fitted capsule 2 on the projectile.

According to the present invention, the program of an electronic processing unit present in the fuse, with which the corrected data transfer to the fuse, occurs in an electronic way. In particular, the system comprises electrically conductive elements, positioned on the fuse, on the front capsule, and for a mutual communication, in order to create an electrically conductive path from a central electronic unit, which controls the firearm, to such processing unit on the fuse.

Such electrically conductive elements comprise a plurality of electrical contacts 21, extending through the lateral surface of capsule 2, and creating an electric continuity from the outside to the inside of the fuse.

Such electric contacts 21 are preferably configured as mutually overlapped annular portions.

On the fuse a connector 31 is present, which electrically connects the processing unit placed inside the fuse with the outside. An electronic connection board 4 between connector 31 and contacts 21 is housed inside the capsule, in such a position to adhere a plurality of conductive tracks 41, positioned on the board 4, with inner portions of contacts 21 of the capsule, and to permit the insertion of a pin 42 in connecter 31 of the fuse.

Advantageously, such capsule 2 comprises an aperture 22 in a position corresponding to the position of connector 31 of the fuse, when the fuse is inserted in the capsule, such to permit in a visible way the connection between connector 31 and pin 42.

The electric connection between the central control unit of the firearm and the capsule can be made by comb contacts (not shown), disposed on a mobile support in advancement and by controlling contacts 21 for the time necessary for programming the fuse.

Preferably, on such connection board 4 a connection circuit 43 between tracks 41 and pin 42 can also be present. Such connection can in turn comprise a decoding circuit or generally for processing signals received from the central unit if the firearm.

The invention claimed is:

1. System for communicating data to a detonating fuse of a projectile of a firearm, for sending said data to a processing unit inserted in said detonating fuse, said projectile being under-calibre with respect to the size of the barrel, for which inserting the projectile correctly into the barrel, said system comprising:

a cap and an adaptor formed by the cap, the cap fitting on the projectile, having an external diameter substantially corresponding to that of the barrel, electrically conductive elements provided on the detonating fuse and on the cap for connection between the elements, to create an electrically conductive path from a central electronic unit, which controls the firearm, to said processing unit on the detonating fuse;

wherein said electrically conductive elements comprise:

a plurality of electrical contacts positioned on a lateral surface of the cap, the contacts creating electrical continuity from the outside to the inside of the cap;

a connector on the detonating fuse, the connector electrically connecting the processing unit within the detonating fuse with the outside of the cap; and an electronic connection board, set between the connector and the contacts, the board being positioned within the cap, in a position to provide engagement of a plurality of conductive paths provided thereon with the contacts of the cap and to enable insertion of a pin into the connector of the detonating fuse.

2. System according to claim 1, wherein said electrical contacts are made as annular portions set on top of one another on the lateral surface of the cap.

3. System according to claim 1, wherein said cap comprises an opening provided in the position corresponding to that of the connector of the detonating fuse when the detonating fuse is inserted in the cap in such a way as to enable the connection to be made between the connector and the pin.

4. System according to claim 1, wherein present on said connection board is a connection circuit for connection between the tracks and the pin.

5. System according to claim 4, wherein said connection circuit comprises a circuit for decoding or processing the signals received from the central unit of the firearm.

* * * * *